US005882506A

United States Patent [19]

Ohsol et al.

[11] Patent Number: 5,882,506

[45] Date of Patent: Mar. 16, 1999

[54] PROCESS FOR RECOVERING HIGH QUALITY OIL FROM REFINERY WASTE EMULSIONS

[76] Inventors: Ernest O. Ohsol, 711 Hyannis Port North, Crosby, Tex. 77532; John W. Pinkerton, 1724 Milford, Houston, Tex. 77098; Thomas E. Gillespie, 1909 Nantucket Dr., Houston, Tex. 77057

[21] Appl. No.: 971,873

[22] Filed: Nov. 19, 1997

[51] Int. Cl.[6] ..... C10G 33/04; C10G 33/00

[52] U.S. Cl. ..... 208/188; 208/186; 208/187; 208/181

[58] Field of Search ..... 208/181, 186, 208/188, 187

[56] References Cited

U.S. PATENT DOCUMENTS

| | | | |
|---|---|---|---|
| 4,432,865 | 2/1984 | Norman | 208/183 |
| 4,938,876 | 7/1990 | Ohsol | 210/708 |
| 5,458,765 | 10/1995 | West | 208/180 |
| 5,507,958 | 4/1996 | White-Stevens | 210/774 |
| 5,738,762 | 4/1998 | Ohsol | 203/11 |

*Primary Examiner*—Walter D. Griffin
*Assistant Examiner*—Tam M. Nguyen
*Attorney, Agent, or Firm*—Jenkens & Gilchrist, P.C.

[57] ABSTRACT

An invention is disclosed whereby refinery waste emulsion streams such as API slop oils, desalter rag layer emulsions, mud pit sludges and the like having high viscosities and specific gravity approaching that of water can be treated for the recovery of processable oil values which had previously been unavailable by adding a sufficient amount of a light hydrocarbon diluent to the emulsion to lower its overall viscosity and to reduce the specific gravity of the oil phase to less than about 0.92. The diluted emulsions are subjected to flashing at emulsion-breaking conditions after which the oil is recovered from the various streams created in the flashing steps.

22 Claims, 1 Drawing Sheet

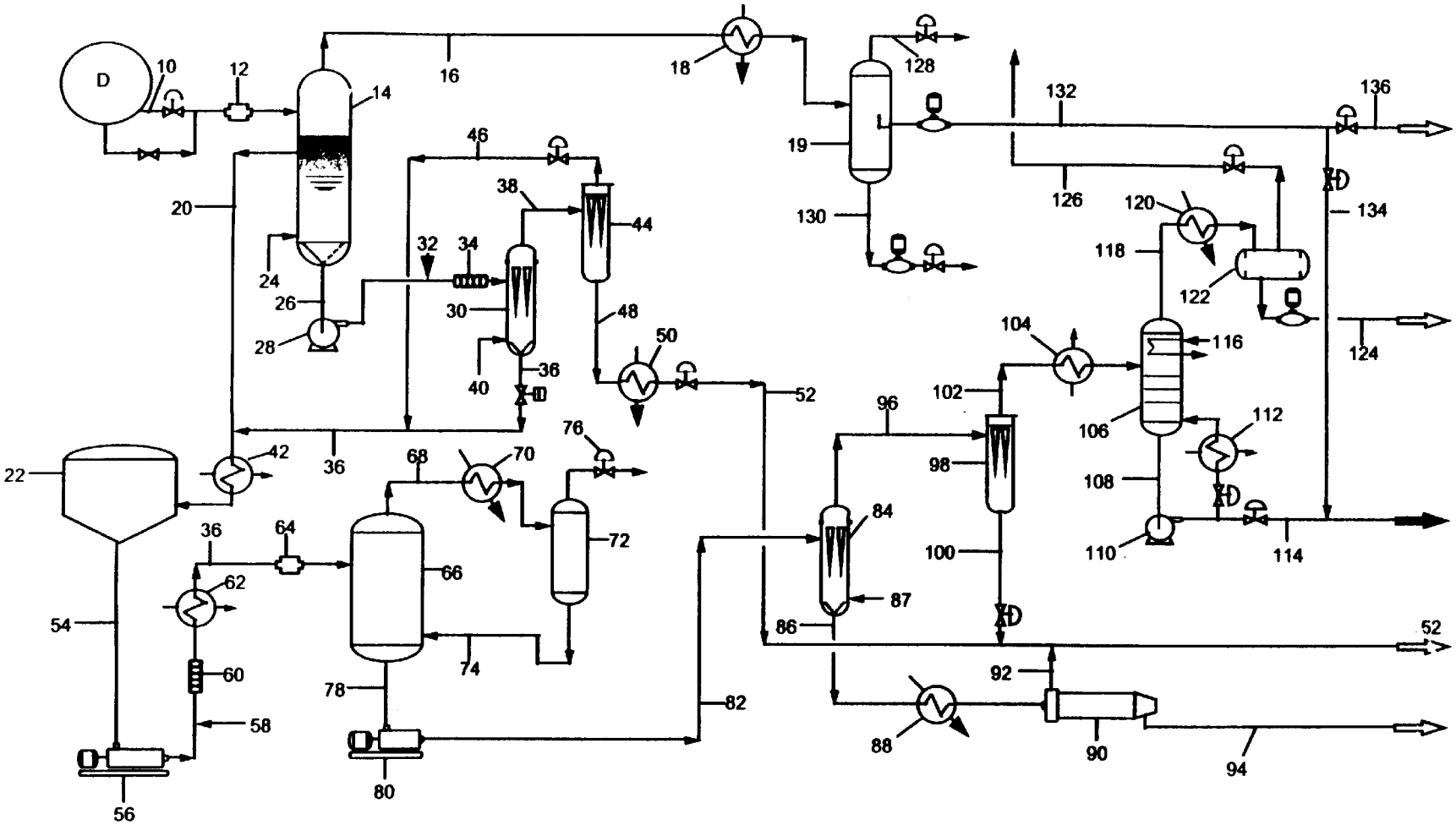
D

PROCESS FOR RECOVERING HIGH QUALITY OIL FROM REFINERY WASTE EMULSIONS

FIELD OF THE INVENTION

This invention describes an improvement in refinery operations whereby processable crude oil is recovered from refinery waste emulsions such as API slop oils and desalter rag layers.

BACKGROUND OF THE INVENTION

In processing crude oil in refinery operations, the presence of intractable emulsions of high specific gravity crude oils often present serious problems leading to oil losses, contamination problems, corrosion, fouling or plugging problems, and expensive environmental treatment/disposal costs. These emulsions can arise during early processing steps at the refinery such as desalting and can also result from the collection of slop oil emulsions from all parts of the refinery. Many produced crude oils contain soluble inorganic salts, such as sodium chloride, calcium chloride, magnesium chloride or sulfate. The presence of such salts in a crude oil is very deleterious to the processing of the oil in a refinery, causing severe corrosion, poor cracking yields, plugging and ultimately equipment failure. It is therefore customary to desalt incoming crude at a refinery by mixing the crude with wash water and allowing the water phase to dissolve the salt and be separated in a desalter vessel.

The intractable emulsions of oil, water and solids make adequate separation and oil recovery difficult. Often, the only answer is that such emulsions arising from desalter are periodically discarded as are other intractable emulsions and slop streams throughout the refinery. This results in expensive treating or handling procedures or pollution problems as well as the fact that processable crude oil is also lost with these intractable emulsions and slop streams.

In most cases, complete separation of water from the oil is inhibited by the presence of an envelope of solid or semi-solid material in a thin-film layer around the surface of each individual water droplet. This material may be inorganic, for example as clay platelets, or silica or limestone particles, or it may be organic such as wax-like or bitumen-like particles. These inorganic and organic solids act as emulsion stabilizers. Furthermore, if the oil has a specific gravity approaching that of water and has a high viscosity, the difficulty of separating these types of oil emulsions is further compounded. The high viscosity greatly hampers the effectiveness of separation equipment.

U.S. Pat. No. 4,938,876 describes a process whereby emulsions can generally be broken by causing a portion of the normally water dispersed phase to flash into vapor by suddenly reducing pressure on the emulsion (flashing) as described in the patent. The flashing action is extremely powerful even when only a small fraction, 10 percent by volume or less, of the dispersed phase is vaporized. The envelope around each droplet is thus shattered so the dispersed phase can be coalesced and separated by gravity, or enhanced gravity forces, when there is a sufficient divergence of specific gravity and a low viscosity. Suitable anti-emulsion chemicals are often added to prevent re-emulsification. The process of the above mentioned patent is successfully operated on a wide variety of intractable emulsion/suspensions, but has been found deficient when the components of the emulsion are not amenable to gravity separation as mentioned above. The patent does not tell one skilled in the art how to deal with the problem of emulsified high specific gravity oil, and only combats high viscosity by heating.

Accordingly, it is an object of this invention to provide a process whereby the components of slop oil emulsions can be readily separated from each other after the emulsion is broken. It is a further object of this invention to provide a process whereby crude oil may be recovered from intractable refinery emulsions for refining as a product. It is a further object of this invention to provide not only for the maximum recovery of oil from refinery waste emulsions, but to allow for environmentally-benign disposal of solids and aqueous components of such waste.

The foregoing objects and other objects which will become obvious to those of ordinary skill in the art after considering this description and drawings of how this advantage is accomplished by the following-described invention.

SUMMARY OF THE INVENTION

In the desalting of heavy (high specific gravity, high viscosity) crude oils, or lighter crude oils containing emulsion stabilizers in the form of clay, asphaltenes, paraffins and other solids, the virgin crude oils are subjected to mixing with about 5–6 percent wash water in one or two stages, usually in horizontal contacting desalter vessels. The crude is generally heated under pressure to lower its viscosity and its specific gravity, thus making it easier to wash the salt out and to separate the oil from the wash water. Commonly, the crude oil may be heated to 200° F. or above, at pressures of 100 psig or more. The crude leaving the desalter through an upper outlet has a low salt-in-crude and sediment-in-crude content, and the salt-laden wash water, or "brine", exits the vessel through a lower-level outlet. For maximum utilization of the desalter's capacity, the water brine withdrawn will include an appreciable amount of oil under-carry in the form of the so-called oil-rich "rag layer" emulsion. Also, the layer at the very bottom will also include an appreciable amount of solids or the so-called "mud wash" which is normally withdrawn intermittently.

In the practice of this invention where the recovery of every processable drop of oil is sought, it is particularly advantageous to combine these three bottom fractions into a single, water-continuous desalter effluent stream containing the brine, the oil-emulsion under-carry including the oil-wetted solids that remain in the oil phase, and the intermittent mud wash solids. This entire desalter effluent stream often contains more than 10 ppm benzene in the water phase. This mixed stream is already at desalter operating conditions of about 5 to 10 atm gauge and about 250° F. and, therefore, upon pressure reduction it may flash into a first stage flash vessel for separating a vapor stream (which will contain most of the dissolved benzene from the aqueous phase), an emulsion stream and an oil-containing solids stream. Most of the dissolved benzene will flash off with the overhead vapors thus leaving less than 10 ppm benzene in the unflashed water phase. A portion of the unflashed liquids may remain as a light emulsion floating above the rest of the liquid in the first stage flash chamber. This layer is normally decanted from the vessel and stored for mixing with other emulsion streams and processing to recover the oil. The bottoms liquids and solids are removed to be subjected to enhanced-gravity separation of the oil/water/solid phases using a hydroclone (hydrocyclone) or similar device. Normally, however, the viscosity and specific gravity of heavy oil makes any separation difficult.

In the practice of this invention, the bottoms effluent from the first stage flash chamber contains the heavy oil residue, solids and other trapped oil values as well as water. It is viscous and has a high specific gravity approaching that of water, making physical separation equipment practically useless. In order to recover the oil from this stream in a condition, for further processing in a refinery, it is mixed with a light hydrocarbon diluent stream in an amount sufficient to reduce the viscosity of the heavy oil to less than about 30 centipoise, preferably below about 10 centipoise, and most preferably to about 1 centipoise. The amount of diluent which is added may be from about 10 percent to about 50 percent by volume based upon the amount of oil in the desalter effluent stream. If no initial flash step is used, the amount of diluent is based upon the percentage of oil in the emulsion treated. The diluent is selected to act as a solvent for the oil phase to be separated from the water and solids. As such, it will also act to reduce the specific gravity of the oil phase to less than about 0.92 and the viscosity to less than 10 centipoise, thereby making it possible to easily separate the components using gravity or enhanced gravity procedures. The objective is separation and oil recovery, not any particular specific gravity. The light hydrocarbon diluent would normally boil at a temperature of from about 20° F. to about 170° F. The low boiling diluent, or solvent, could be selected from light hydrocarbons such as, for example, $C_3$ through $C_6$ alkyl hydrocarbons, naphtha, aromatic distillate, aromatics such as toluene or mixtures of any of the foregoing. It is the solvency, availability and recovery that is important, not so much the individual, specific hydrocarbon diluents chosen. The determination of suitable light hydrocarbon can be easily made by routine experimentation well-known to those skilled in the art.

The light hydrocarbon diluent selected is added in the sufficient amount to create the properties in the bottoms stream as discussed above, mixed and then fed to a hydrocyclone system for separation of solids as bottoms from other emulsions and water taken out overhead. The first hydrocyclone bank separates a concentrated slurry of solids (a de-sanding step) and then passes the de-sanded liquid mixture through a second dewatering hydrocyclone bank to remove as much non-emulsified water as practical. The remaining oily stream will be an oil-continuous, concentrated emulsion containing the intractable emulsion referred to above. This emulsion stream recovered from the dewatering hydroclone is blended with the emulsion directly decanted from the first-stage flash step and with the concentrated solids slurry from the desanding step which still may include some emulsified oil. If desired, other refinery emulsions (such as API slop oils) can be mixed with the desalter emulsions for a common recovery of oil in the second emulsion breaking flash step. Alternatively, the other refinery emulsions (such as API slop oil) can be brought to an adequate temperature and pressure so that upon pressure reduction these may flash into the first stage flash vessel along with the desalter effluent. This flashing activity may be through the same or through a different nozzle on the flash vessel as that used by the desalter flash activity. This mixture, which includes the diluent/solvent, is then subjected to a second emulsion-breaking flash step conducted in as described in U.S. Pat. No. 4,938,876 which is incorporated herein for all purposes. The second-stage flash chamber will generally operate at a pressure of 5 to 10 psig. This flash step completes breaking the emulsion, thereby leaving the discrete phases of oil, water and solids in a condition for successful gravity separation and oil recovery. The advantage of two separate flash steps is the greatly reduced volume of free water required to be heated prior to flashing and the presence of the diluent in finally breaking all the emulsions.

The vapor stream from the second stage flash will contain additional light end hydrocarbons plus a considerable portion of the diluent along with the flashed water. The condensate from this stream is suitable for recycle and remix with the remaining liquids in the second-stage flash chamber, thereby keeping all of the diluent as a part of the separate oil phase along with the separate water phase.

Since the liquids from this flash chamber are no longer emulsified and there is now a low viscosity oil and an adequate gravity differential between the oil and water, they can be separated by conventional enhanced-gravity means such as a bank of desander hydroclones followed by a bank of dewatering hydroclones or by the use of centrifuges or combination of the two. The solids slurry from desander hydroclones can be dewatered by known steps such as the use of a centrifuge. The remaining oil phase is now dry crude oil plus the added diluent. The oil is suitable for processing in normal refinery crude oil distillation units. The diluent can be recovered as part of a normal refinery distillation process and recycled as needed or, alternatively, recovered in a separate diluent stripping system. The separated water is solids-free, low in benzene and suitable for conventional treatment. The final solids cake can be made relatively dry or, left alternatively, relatively wet for various economic disposal methods. In both cases, the solids cake will have a low benzene content.

BRIEF DESCRIPTION OF THE DRAWING

The attached FIGURE is a flow diagram of the preferred embodiment of the process of this invention for the recovery of processable crude oil from waste oil emulsions discharged in refinery operations.

DETAILED DESCRIPTION OF THE INVENTION

This process is useful for recovery of useful crude oil from the various refinery waste streams having emulsified oil such as desalter effluent streams, API separator oils, waste oils and the like. Characteristically, these slop streams have high viscosity, high specific gravity oil and often high solids and water. This is a flexible process which may be used by those skilled in the art to recover processable oil from many different refinery wastes.

The process of the invention may include steps for the complete processing to recover crude oil, but not necessarily all of the steps described below. Refinery streams vary widely in characteristics, composition and properties. Many variations in treatment will be evident from the following description of methods for recovering the oil. Those skilled in the art will see many useful variations of the practice of this invention.

The refinery streams to be treated by the practice of this invention are brought to a sufficiently high pressure and temperature to feed the oil through a flash system as described in U.S. Pat. No. 4,938,876, which is incorporated herein by reference for all purposes. The pressure may be in the range of 50 to 250 psig or in some cases even higher, and a pre-flash elevated temperature of from about 250° F. to about 350° F. is provided. Again, it depends upon the waste emulsion stream being processed. An emulsion stream taken directly from the desalter may already be above 250° F. and at about 150 psig. This stream, particularly if a desalter effluent stream having high temperature and pressure exiting the desalter is used, can be flashed by sudden pressure reduction at this point to take a vapor stream overhead and an intermediate oil-water emulsion stream and a solids stream containing recoverable oil as a bottoms. The emulsion will preferably be decanted out of the flash vessel and held for later processing. The bottoms stream will be removed from the vessel and diluted with a light hydrocarbon to reduce the viscosity of the waste emulsion stream to less than 30 centipoise, preferably from about 1 to about 5 centipoise. It is advantageous to operate at as low a viscosity as reasonably possible in order to enhance the gravity separation in the equipment, preferably hydrocyclones or "hydroclones," later in the process. Since phase separation is involved it is an advantage to have as clear a separation as possible. Thus, the specific gravity of the diluent and its affinity, or solubility, for the oil in the emulsion is also important. It is, therefore, part of the practice of this invention to reduce the specific gravity of the oil in the refinery emulsions to about 0.92 or below, preferably below about 0.90 in addition to the viscosity reduction. Thus, when the emulsions are broken in the practice of this invention, the phase separations between the water and oil phase will be essentially complete.

The hydrocarbon added would normally be selected from $C_3$ to $C_6$ alkyl hydrocarbons, toluene, kerosene, aromatic distillates, or other light refinery streams or mixtures thereof, preferably with a boiling point of from about 20° F. to about 170° F. The selected hydrocarbon diluent, from about 10 to 50 percent by volume, based upon the oil content of the desalter bottoms effluent, would be added, preferably, from about 15 to about 35 percent by volume. This is added to reduce the viscosity to less than 30 cp, preferably to 10 cp and most preferably from about 1 to about 5 cp, such that the separation steps after flashing are more easily accomplished. In addition, the diluent serves to reduce the specific gravity of the oil phase again making it easier to separate from the water phase.

After blending the diluent with the bottom streams of the initial flash chamber, it is preferable that hydroclone separation be used to separate the solids, emulsions and free water. The water eliminated from the system at this point is suitable for further processing at a refinery treater. Having collected the desalter emulsion streams (as well as other emulsion streams if desired), the streams are brought up to pressure and temperature in preparation for a second stage flash. Suitable de-emulsifying chemicals are added as needed to the pressurized diluted oil/water/solids emulsion stream in amounts in the range of 100 to 2000 ppm by volume. Neutralizers may also be added when required. Suitable chemicals are well-known and are readily obtained from Petrolite, BetzDearborn, Nalco or other suppliers. The additives may include anionic, cationic, nonionic and polymeric compounds. Polymeric additives are used in relatively small dosages to encourage coagulation of extremely fine solids contaminants.

The above-mentioned U.S. Pat. No. 4,938,876, describes in detail many combinations of treating chemicals which may be added to such a stream at this point and which advantageously assist in the later oil recovery. The chemicals are added in appropriate amounts to the emulsion and diluent stream. The chemicals added, as well as the amount can easily be determined by the skilled process engineer.

The emulsions encountered in this process are broken by the flash step, but due to agitation in the following steps there may be a tendency to reestablish emulsions. When the emulsions encountered are of the oil-in-water type, it is desirable to add a surfactant favoring water-in-oil emulsion. Conversely, if the emulsions expected are of the water-in-oil type, a surfactant favoring oil-in-water emulsion should be used. Only small quantities of these counter-emulsifiers should be necessary. In fact, over-dosing can be counter productive.

The emulsion with additives mixed in is heated to an appropriate temperature in the range of from about 250° to about 350° F. and passed through an expansion valve into a second stage flash tank. This diluted, hot, pressurized waste emulsion stream and its additives is passed through the flash controller such that the flashing of the stream vaporizes about 2 to 15 percent of the emulsion/water/solvent blend. This flashing step causes water-oil emulsions to be broken into their separate components as described in U.S. Pat. No. 4,938,876 incorporated herein for all purposes, with light ends passing out overhead to a condenser and run-down tank. The condensed vapors will yield a water layer and a hydrocarbon layer above it. Both of these layers may normally be recycled to mix with the second stage flash chamber bottoms.

Most of the oil stream and the diluent, or solvent, remains unvaporized and since the emulsions are now broken, the components can be separated by mechanical means such as by passing through one or more hydrocyclone separators in series, arranged according to known engineering principles. The hydrocyclone system may be preferably arranged in two stages, solids being removed in the first stage and water in the second. The solids from the first stage will contain some oil and other contaminants which may be removed by washing the solids in a continuous centrifuge using a detergent-containing water wash. The clean solids may then be safely disposed, as an additive for cement manufacture, as a solid fuel, or for land fill.

The water separated in the second stage hydroclone will contain any soluble salts obtained from the crude oil, and may be discarded as a brine to conventional brine treating facilities.

The overhead from the final hydroclone separator will contain the product oil and the diluent. Following standard engineering principles, this can easily be separated to recover the diluent for further use and free the product oil for further refining into saleable products. An alternate step would be to leave diluents in the recovered oil for final recovery and recycle as part of the refinery crude oil processing when this is more advantageous. As is clear from the foregoing, an economic enhancement is derived from the practice of this invention. The separation of the diluent from the oil can be handled in a stripping column where a heated feed is introduced with the diluent coming off the top of the column and the oil from the bottom using a reboiler to supply additional heat and a reflux condenser at the column. Such strippers are popular refinery apparatus well-known to the skilled engineer.

The foregoing invention will be illustrated by the discussion of the following example with the accompanying drawing to better illustrate a preferred embodiment of this invention. This invention is an improvement over that described in U.S. Pat. No. 4,938,876, incorporated herein by reference for all purposes and is particularly advantageous in connection with the treatment of these viscous slop emulsified waste streams created during refinery processing. The process of this invention lends itself well to modularization and thus can be practiced using only the embodiments which are applicable for particular waste streams involved and the result desired. As discussed above, the improvement involves adding a diluent/solvent to the waste oil emulsion to reduce its viscosity and specific gravity. The diluent assists in a cleaner separation of the oil phase from the aqueous and solids phases in the broken emulsion. This invention also provides for the removal of excess water in a first stage flash step thereby greatly enhancing the economy of the emulsion breaking system.

The foregoing general description of this invention will be further illustrated by the following illustrative embodiment. It is to be understood that the embodiment is given for the purpose of illustration only and that the invention is not to be regarded as limited to any specific materials or conditions or parameters set forth in the specific embodiment. Because of the broad scope of waste refinery emulsions which may be treated in the practice of this invention, many variations and combinations are possible. Rather than reproduce all criteria in this specification, reference should be had to the prior art U.S. Pat. No. 4,938,876, which issued Jul. 3, 1990, and is incorporated herein by reference for all purposes. This referenced patent describes, as having set forth above, the addition of chemical additives which are not part of this invention, but may enhance the applicability of same.

EXAMPLE NO. 1

The process of this invention can be more readily understood by following the embodiments described in this example, while referring to the attached figure. This describes the treatment of crude oil emulsions discharged from desalters. Other refining waste emulsions may be treated in substantially the same way, or can be mixed with the desalter effluent at an advantageous step in the process. Oil-water-solids emulsions as well as free water and suspended solids are continuously and/or periodically released from the lower portion of a desalter D, typically at a temperature of about 250° F. and a pressure of about 150 psi gauge, shown as stream 10. This stream is released through a flash controller valve 12 into a first-stage flash chamber 14 where the pressure is about 10 psi gauge. Low boiling hydrocarbons (including benzene), water vapors and some contaminant low boiling materials such as hydrogen sulfide are released in the vapor phase and pass through line 16 on to a condenser 18 serving to condense most of the water and hydrocarbons, which are collected in stabilizer 19. The condenser 18 is operated at a temperature in the range of from 40° to 90° F. Flash chamber 14 may be operated at either subatmospheric conditions or superatmospheric conditions depending upon the most convenient operating parameters extant at the refinery, taking into consideration the emulsion characteristics of the streams being treated.

The liquids and solids in flash chamber 14 settle to give a bottom layer containing mostly water and suspended or entrained solids, and an upper layer containing oil emulsified with some water. This emulsion layer is usually intractable, and is removed through line 20 through cooler 42 into emulsion surge tank 22. The aqueous bottom lower layer is encouraged to drain out of chamber 14 with a small amount of wash water entering at line 24, through line 26, to pump 28 to a bank of desanding hydroclones 30 for a separation of solids from the oil stream. Prior to entering the hydroclone 30, a stream of light hydrocarbon diluent is added through line 32, to this bottoms stream and blended in in-line mixer 34. This diluent stream may be from about 10 percent to about 50 percent by volume based upon the oil content of the desalter D effluent stream, preferably from about 15 to about 35 volume percent of the stream and is intended to lower the viscosity and specific gravity of the oil phase so that the mixture can be easily separated in hydroclones 30 and later in the process. The diluent is added to achieve preferred viscosity of from about 1 to about 5 centipoises and a specific gravity of less than about 0.90.

The light hydrocarbon diluent would normally boil at a temperature of from about 20° F. to about 170° F. The low boiling diluent, or solvent, could be selected from light hydrocarbons such as, for example, $C_3$ through $C_6$ alkyl hydrocarbons, naphtha, aromatic distillate, aromatics such as toluene or mixtures of any of the foregoing. It is the solvency, availability and recovery that is important, not so much the individual, specific hydrocarbon diluents chosen. The determination of suitable light hydrocarbon can be easily made by routine experimentation well-known to those skilled in the art from diluent already available in the refinery. The diluent may be advantageously added at one or more points in the process, but the overall amounts and criteria for addition herein are maintained.

Mixer 34, preferably an in-line "KENICS" mixer, is provided to ensure thorough blending of the diluent and the other liquids in the stream. The blend is now fed into the desanding bank of hydroclones 30, from which a slurry of solids in water of perhaps 5 to 15 weight percent solids is taken out in line 36. A small amount of wash water is provided through line 40 to hydroclone 30 to ensure removal of solids. The solids slurry passes through line 36 to join the emulsions in line 20 and passes through cooler 42 into surge tank 22. The water-solids slurry from line 36 is only a small portion of the mixture in surge tank 22, about one percent or less, but includes some recoverable oil content. The overhead, essentially solids-free, stream of water and the emulsions leave hydroclone 30 through line 38 and pass into the second bank of hydroclones 44, which serve to dewater the oil emulsions and diluent stream blend which exits as an overhead stream through line 46 and is fed to surge tank 22 through lines 36 and 20. The bottoms effluent from hydrocyclone 44 in line 48 is water containing small amounts of dissolved hydrocarbon, which passes through cooler 50 and is released through line 52 to join other refinery process wastewater for final treatment.

The oil-rich emulsion from surge tank 22, diluted with the hydrocarbon, is taken via line 54 into a progressive cavity pump 56 to provide a pressure of from about 100 to about 200 psi gauge. Emulsion-breaking additive chemicals, as described in U.S. Pat. No. 4,938,876 (incorporated by reference for all purposes), in small dosages are injected at 58, followed by an in-line mixer 60. This stream passes through trim heater 62 to raise the temperature to about 300° F. The mixture is then released through flash control valve 64 into the second-stage flash chamber vessel 66 which is operated at approximately 10 psi gauge. The flash chamber vessel 66 may be operated at either subatmospheric conditions or superatmospheric conditions depending upon the most convenient operating parameters extant at the particular refinery, taking into consideration the emulsion characteristics.

At this point the oil-water emulsion is broken with flashed vapors containing some light hydrocarbon diluent and water exiting vessel 66 via line 68 to condenser 70 and receiver 72 from which the water and hydrocarbon condensate are returned to vessel 66 through line 74. Non-condensible gasses are vented from receiver 72 through pressure control valve 76. The oil-water-solids slurry from vessel 66 passes out through line 78 into progressive cavity pump 80, through line 82 into a bank of desanding hydroclones 84, from which a substantially oil-free slurry of solids in water is discharged at line 86. The slurry may be washed with a water stream, optionally containing a small amount of detergent, entering through line 87. This slurry may advantageously be cooled to below 180° F. in cooler 88 and fed to centrifuge 90. The centrifuge 90 is designed to discharge "clean" water (essentially free of benzene) through line 92 to join wastewater stream 52 for final treatment. A concentrated solids stream is discharged from the centrifuge 90 through line 94 for processing as an essentially non-hazardous material, for disposition to a coker, other recycling options, or other final environmentally benign disposal alternatives. The lower density overhead stream exiting the desander hydroclones 84 through line 96 is a mixture of oil (with diluent) and water, which could settle and separate in a tank, but is preferably fed from line 96 to a final bank of dewatering hydroclones 98. Here, the reject stream of water is taken out in line 100 for release to final wastewater stream 52, while the overhead stream of oil plus diluent exits through line 102 through heater 104 into diluent stripper 106. Alternatively, all the diluent could be left with the separated crude for recovery during refinery crude distillation processing. This option would eliminate the need for a separate diluent stripping step. The stripper 106 is designed to take overhead substantially all the diluent (for recycle) and leave as bottoms dry, clean, desalted crude oil for charging to the refinery units for further processing. If desired, some diluent could be left in this crude stream. The stripper 106 has a pump-around reboiler, line 108, pump 110, reboiler 112, which supplies heat to strip the diluent, and final oil product discharge line 114. The overhead vapors in stripper 106 are partially condensed by reflux cooler 116 to provide some reflux, with the main stream of recovered diluent vapors passing through line 118 into condenser 120 and accumulator 122, from which recovered diluent exits through line 124. Non-condensible vapors leave the accumulator 122 and are released by line 126 through a pressure control valve. The non-condensibles from line 126 join other non-condensibles released from stabilizer 19, exiting at line 128. The stabilizer vessel 19 acts also as a decanter, allowing condensed water to be drained off via line 130 recycle as desalter make-up water, for benzene stripping or further treating. Condensed hydrocarbon light ends are decanted through line 132 to be remixed into the crude oil product through line 134 to line 114. Alternatively, these light hydrocarbons can be sent via line 136 to a separate collecting point depending upon the refining needs.

As can be seen by the foregoing general description and specific embodiment of the process of this invention, crude oil otherwise tied up as useless and creating an environmental problem from refinery waste stream emulsions is recovered and returned so that useful product can be made from it at the refinery. Also, what had been troublesome, contaminating solids and water are cleaned to the point of being disposable in an environmentally benign manner. As the refinery waste emulsions for virtually every refinery and crude oil source are different, the simple test methods well-known to those skilled in the art can be used to determine the specific practices to be followed in obtaining the advantages of this invention. Those variations of parameters are intended to be within the scope of the invention as set forth in the following claims.

I claim:

1. A process for recovering high-density petroleum oil from an aqueous waste refinery emulsion stream comprising:

adding to and mixing with said emulsion stream from about 10 to about 50 percent, by volume based upon the oil in said emulsion stream, of a light hydrocarbon diluent to reduce the viscosity and reduce the specific gravity of the oil in said emulsion stream;

flashing said emulsion stream into a vapor stream and a liquid stream having a water phase and an oil phase; and separating the oil phase from the water phase.

2. The process of claim 1 wherein the vapor stream comprises water vapors, and hydrocarbon diluent vapors.

3. A process for recovering heavy petroleum oil from an intractable refining emulsion comprising:

blending a low-boiling, low viscosity hydrocarbon diluent with said refining emulsion to form an emulsion-hydrocarbon diluent mixture;

heating said emulsion-hydrocarbon diluent mixture under pressure to create conditions for flashing said emulsion-hydrocarbon diluent mixture;

flashing said emulsion-hydrocarbon diluent mixture at a sufficient pressure to cause at least about 5 percent of liquids contained in said emulsion-hydrocarbon diluent mixture to vaporize, breaking the emulsion in the emulsion-hydrocarbon diluent mixture to form an emulsion free mixture containing heavy petroleum oil, hydrocarbon diluent, water and solids; and separating the components of said emulsion free mixture.

4. The process of claim 3 wherein the flashing of the diluted emulsion occurs at a superatmospheric pressure.

5. The process of claim 3 wherein the flashing of the diluted emulsion occurs at a subatmospheric pressure.

6. The process of claim 3 which includes the step of injecting into said emulsion-hydrocarbon diluent mixture prior to the flashing step of said emulsion-hydrocarbon diluent mixture effective amounts of de-emulsifiers and flocculants as well as chelants for heavy metal removal.

7. The process of claim 3 which includes the step of recovering the low-boiling diluent from the oil.

8. The process of claim 7 wherein the recovered diluent is recycled for injection into the emulsion.

9. The process of claim 3 wherein said separating step comprises:

feeding said emulsion free mixture to a hydrocyclone;

separating a slurry of solids stream issuing from the bottom of said hydrocyclone and an essentially solids free liquid stream issuing from the top of said hydrocyclone, wherein said essentially solids free stream contains water, heavy petroleum oil and hydrocarbon diluent; and feeding said essentially solids free stream to a continuous centrifuge;

separating a water stream at one end of said centrifuge and an oil phase stream containing the heavy petroleum oil and hydrocarbon diluent at the other end of said centrifuge;

feeding said oil phase stream into a stripper; and separating a hydrocarbon diluent stream at one end of said stripper and a heavy petroleum oil at the other end of said stripper.

10. The process of claim 3 wherein said separating comprises:

feeding said emulsion free mixture into a settler;

allowing the mixture to settle in said settler for a sufficient time as to form two layers, a first bottoms layer comprising water and solids and a second top layer comprising essentially of heavy petroleum oil and hydrocarbon diluent; and decanting said upper layer to recover said heavy petroleum oil and hydrocarbon diluent.

11. A process for the recovery of refinable crude oil from refinery waste emulsion streams which comprises the steps of:

separating the refinery waste emulsion streams to form an aqueous bottoms slurry stream, a first oil emulsion stream and an overhead vapor stream;

adding and mixing a sufficient amount of a light hydrocarbon diluent to said aqueous bottoms slurry stream to result in a specific gravity of the oil in the aqueous bottoms slurry stream of less than about 0.92 and a viscosity of less than about 30 cp;

separating a second oil emulsion stream from the diluted aqueous bottoms slurry stream wherein said second oil emulsion contains the hydrocarbon diluent;

combining said first and second oil emulsion streams to form a combined oil emulsion stream;

flashing the combined oil emulsion stream under emulsion-breaking conditions into a vapor stream and a liquid stream containing solids, water, oil and hydrocarbon diluent; and recovering oil product capable of further refining from the liquid stream.

12. The process of claim 11, the hydrocarbon diluent added is sufficient quantity so that the oil phase has a viscosity below about 10 centipoise at 200° F.

13. The process of claim 11 further comprising the step of adding additional hydrocarbon diluent to said first oil emulsion in an amount sufficient to reduce the specific gravity of the oil contained in said first oil emulsion to less than 0.92 and the viscosity of the oil contained in said first oil emulsion to less than 30 cp.

14. The process of claim 11 wherein said separating step of the refinery waste emulsion stream comprises flashing said refinery waste emulsion and wherein said separating step of said second oil emulsion stream comprises feeding said aqueous bottoms slurry stream through a series of hydrocyclones to remove a solid slurry and free water, and separate said second oil emulsion stream.

15. A process for recovering refinable crude oil from a hot, heavy oil emulsion desalter bottom which comprises the steps of flashing the hot, heavy oil emulsion desalter bottom from a pressure above about 75 psig and a temperature above about 250° F. into a flash chamber having a pressure of less than about 20 psig to form a vapor stream, a first oil emulsion stream and a bottoms stream containing free water, solids and oil emulsion;

separating the free water and solids from the bottoms stream by enhanced-gravity separation means to form a second oil emulsion stream;

adding and mixing a sufficient amount of a light hydrocarbon diluent to result in a specific gravity of the oil in said second oil emulsion stream of less than about 0.92 and a viscosity of less than about 30 cp;

combining said first oil emulsion stream with said second oil emulsion stream;

flashing the combined oil emulsion stream under emulsion-breaking conditions into a vapor stream and a liquid stream wherein said liquid stream is free of oil emulsion containing solids, water, oil and diluent; and recovering oil product capable of further refining from the liquid stream.

16. A process for recovering processable crude oil from refinery waste emulsions including one or more of desalting effluent streams, API emulsion bottoms or other refinery slop streams having high viscosity and containing oil having an average specific gravity approaching that of water, comprising the steps of:

flashing the waste streams from a temperature of at least about 250° F. and pressure of from about 5 to about 10 atm to a temperature of less than about 215° F. to cause vaporization of water, resulting in a vapor stream, a first oil emulsion stream and an oil-containing solids stream;

mixing with the oil-containing solids stream a sufficient amount of a hydrocarbon liquid diluent to reduce the viscosity of the contained oil to from about 1 to about 5 centipoise and the specific gravity of the contained oil to less than about 0.90;

separating a second oil emulsion stream from the oil-containing solids stream wherein said second oil emulsion stream contains said diluent;

combining the second oil emulsion stream with the first oil emulsion stream from the flashing of said waste streams step;

flashing the combined emulsion streams including the diluent at emulsion breaking conditions into a three-phase, oil-water-solids slurry having an oil phase a water phase and a solids phase wherein said oil phase contains oil and diluent;

recovering the oil from the oil-water-solids slurry and placing water and solids in condition for environmentally satisfactory treatment.

17. The process of claim 16 wherein said recovering step comprises the steps of removing the solids and the water from the oil-water-solids slurry to recover an oil phase containing oil and diluent that is substantially free of water and solids separating the oil from the diluent, and recovering the oil.

18. The process of claim 17 wherein said removing of the solids and water from the oil-water-solids slurry further comprises the steps of:

feeding said oil-water-solids slurry to a first hydrocyclone or centrifuge;

removing the solids from said oil-water-solids slurry to recover a solids free, oil-water mixture;

feeding said recovered oil-water mixture to a second hydrocyclone or centrifuge;

separating the water phase from the oil phase of said oil-water mixture.

19. The process of claim 17 further comprising the steps of recovering the diluent from the oil for reuse in the process.

20. A process for recovering clean refinable crude oil from a refinery desalter effluent brine containing an oily emulsion comprising:

flashing said refinery desalter effluent brine from a pressure above about 35 psig to a sufficiently lower pressure to cause at least about 5 percent of said refinery desalter effluent brine to vaporize;

separating the effluent brine into a vapor stream, a first oil emulsion stream and an aqueous stream containing oil and solids;

separating said aqueous stream into a solid-rich stream, a water stream containing small amounts of hydrocarbons and a second oil emulsion stream;

segregating the water stream for conventional waste treatment;

mixing said first and second oil emulsions and the solid-rich stream concentrate to form an oil emulsion mixture for a second emulsion-breaking treatment;

adding a hydrocarbon diluent to the oil emulsion mixture in sufficient amounts to reduce the viscosity of the oil emulsion mixture to from about 1 to about 5;

flashing the oil emulsion mixture under emulsion breaking conditions to break the oil emulsion and form a vapor stream containing water vapors and diluent vapors and a solids containing liquid stream wherein said solids containing liquid stream is free of oil emulsions;

recovering a crude oil product from the solids containing liquid stream for normal petroleum oil refinery operations;

removing an aqueous fraction from the solids containing liquid stream for normal wastewater treatment;

separating and disposing of a solid-rich fraction from the solids containing liquid stream in an environmentally benign fashion; and condensing the water and diluent vapors of said vapor stream formed from the flashing of the oil emulsion mixture to form a condensate; and using the condensate as diluent.

21. The process for separating high specific gravity, high viscosity oil from stable emulsions of oil, water and solids the process comprising flashing said stable emulsion into a first flash vessel to form vapors comprising water and light hydrocarbons, and a liquid having two distinct layers, an upper oil-water emulsion layer and a bottoms layer containing water, oil and solids;

separating said oil-water emulsion layer from said bottoms layer to form a first oil emulsion stream and a bottoms stream;

adding a light hydrocarbon diluent to said bottoms stream in an amount of from about 10 to about 50 percent by volume based upon the amount of oil in the desalter effluent emulsion stream to form a diluent-bottoms mixture;

separating solids and water from said diluent-bottoms mixture to form a second oil emulsion stream containing diluent;

mixing said first oil emulsion stream with said second oil emulsion stream to form a combined oil emulsion stream containing diluent;

heating said combined oil emulsion stream to a temperature of from about 250° F. to about 250° F. under a pressure of from about 50 to about 250 psig;

flashing said heated combined oil emulsion stream into a second flash vessel to a sufficient low temperature and pressure to break the oil emulsion and form a liquid mixture containing oil, diluent, solids, and water, and a vapor stream containing water, diluent and other light hydrocarbons, found in the desalter-effluent emulsion stream;

separating the solids and water from said liquid stream from said second flash vessel to form an oil stream containing diluent; and separating the oil from said diluent containing oil stream.

22. The process of claim 21 wherein said stable emulsion is a desalter effluent emulsion stream having a pressure of from about 73 to about 147 psig, and a temperature of from about 200° to about 300° F.

* * * * *